US007735148B1

(12) United States Patent
Turman

(10) Patent No.: US 7,735,148 B1
(45) Date of Patent: Jun. 15, 2010

(54) CARPET INSTALLER'S KNEE HAMMER

(76) Inventor: Paul D. Turman, 30910 Apawamis Dr., Sorrento, FL (US) 32776

( * ) Notice: Subject to any disclaimer, the term of this patent is extended or adjusted under 35 U.S.C. 154(b) by 52 days.

(21) Appl. No.: 12/077,401

(22) Filed: Mar. 18, 2008

Related U.S. Application Data

(63) Continuation-in-part of application No. 11/025,526, filed on Dec. 30, 2004, now abandoned.

(51) Int. Cl.
*A41D 13/00* (2006.01)

(52) U.S. Cl. ..... 2/22

(58) Field of Classification Search ..... 2/24, 2/22, 16, 455, 911, 62; 297/423.1
See application file for complete search history.

(56) References Cited

U.S. PATENT DOCUMENTS

| | | | | |
|---|---|---|---|---|
| 2,484,494 | A | 10/1949 | Ferguson | |
| 2,627,301 | A | 2/1953 | Emmett | |
| 3,382,503 | A | 5/1968 | Ramon | |
| 3,908,198 | A | 9/1975 | Brock | |
| D255,281 | S | 6/1980 | Breilenstine | |
| 4,346,784 | A | 8/1982 | Hammond | |
| 4,747,470 | A | 5/1988 | Fernandez | |
| 5,090,055 | A | 2/1992 | McElroy | |
| 5,220,691 | A | 6/1993 | Wiegers | |
| 5,870,774 | A | 2/1999 | Legenstein | |
| 6,256,787 | B1 * | 7/2001 | Tyler | 2/22 |
| 6,347,404 | B1 | 2/2002 | Iskra | |
| 6,802,080 | B2 * | 10/2004 | Hawley | 2/22 |
| 6,845,515 | B2 * | 1/2005 | Sveilich | 2/22 |
| 7,409,725 | B1 * | 8/2008 | Horstman | 2/22 |

* cited by examiner

*Primary Examiner*—Tejash Patel
(74) *Attorney, Agent, or Firm*—Randal D. Homburg

(57) ABSTRACT

A device worn upon a carpet installer's lower leg, provides an impact hammer for installation tools, including carpet stretching devices, the device protecting the knee of the installer during use and also optimizing the amount of horizontal impact which can be delivered to the installation tools. The device may be adjusted to fit the lower leg of a variety of installers and the device also provides an adjustable weight suited to the comfort and needs of the particular carpet installer. The device, having a smooth lower surface, is also provided to assist in the seaming process of carpet installation, providing a smooth, flat vertical force required for proper flooring seam adherence.

7 Claims, 4 Drawing Sheets

CARPET INSTALLER'S KNEE HAMMER

CROSS REFERENCE TO RELATED APPLICATIONS

This is a Continuation-in-Part Application of application Ser. No. 11/025,526 filed by the same Inventor on Dec. 30, 2004 now abandoned.

BACKGROUND OF THE INVENTION

1. Field of Invention

A device worn upon a carpet installer's lower leg, provides an impact hammer for installation tools, including carpet stretching devices, the device protecting the knee of the installer during use and also optimizing the amount of horizontal impact which can be delivered to the installation tools. The device may be adjusted to fit the lower leg of a variety of installers and the device also provides an adjustable weight suited to the comfort and needs of the particular carpet installer. The device, having a smooth lower surface, is also provided to assist in the seaming process of carpet installation, providing a smooth, flat vertical force required for proper flooring seam adherence.

2. Description of Prior Art

The following United States patents were discovered and are disclosed within this application for utility patent. All relate to devices worn on the lower leg of a laborer.

A first group of prior art patent address concrete laborers and knee float devices worn on the leg of the concrete laborer to allow the laborer to trowel concrete with a hand trowel while in a kneeling position, with the knee float devices worn to prevent disruption of the finished concrete surface from the knees and toes of the user. A first patent within the concrete float device category is U.S. Pat. No. 2,627,301 to Emmett, which discloses a lower flat float, a knee pad which provides knee protection in a vertical plane, a padded shin support with a strap to connect the device to the knee and calf of the carpet finisher, and an elevated toe holder. A second patent within this category is U.S. Pat. No. 4,346,784 to Hammond, which also discloses knee support apparatus having a lower flat float, a front knee stop, a quantity of cushion material along the entire upper surface of the lower flat float in contact with the leg of the concrete finisher, and an adjustable soft roller between two upright supports provided for the concrete finisher's foot to rest against while using the float, the apparatus sliding forward and backward by the user's leg without leaving an impression in the finished concrete surface. Other prior art patents in this category include U.S. Pat. No. 6,347,404 to Iskra, D255281 to Breitenstine, and U.S. Pat. No. 4,747,470 to Fernandez. None of these categorically related devices provide a forward impact area for use as a horizontally deployed hammer attached to a leg of a laborer for the delivery of a horizontal impact to a knee actuated carpet installation device, nor do they define a device which protects the front portion of the knee from a horizontal forces, nor do they define the same or similar elements as the present knee hammer.

A second category of device actually do relate to the installation of carpet or flooring. In a first U.S. Pat. No. 3,908,198 to Brock, a seam skate for carpets is disclosed, providing a knee board for being pushed along a carpet seam of a carpet behind a hot melt seaming iron, the lower surface of the board being flat with beveled edges to slide along a carpet surface, and an upper surface providing an upstanding padded block to support the foreleg and an upward extending cup fitted with a thick pad extending down the inner surface of the cup and across a portion of the upper surface to protect and support the knee, as indicated in FIG. 2 of that patent. U.S. Pat. No. 5,090,055 to McElroy provides a knee pad which is strapped onto the knee for vertical support of the knee while kneeling. It also discloses an air cushion as the cushioning material. In U.S. Pat. No. 5,870,774 to Legenstein, a rolling knee pad is disclosed, strapped on and worn by a laborer when installing rolled flooring materials and U.S. Pat. No. 2,484,494 to Ferguson discloses a lower leg support, strapped to an entire foreleg, having wheels. None of these disclosed patents are intended for, nor supplied with components for use as a horizontal knee hammer for knee actuated impact tools for carpet installation.

A third category discloses a single U.S. Pat. No. 5,220,691 to Wiegers, which is a knee pad, strapped onto the knee of a laborer, with an adjustable strap also attaching the knee pad to a belt, the knee pad having a frontal contact surface which engages the kicking pad of a carpet stretcher during the installation of carpets. This device actually provides and discloses a use similar to the carpet installer's knee hammer of the present invention, except for the obvious lack of other significant elements disclosed in the present knee hammer to distribute the horizontal impact forces incurred by the device over repeated uses as a hammer over the entire leg. Wiegers does not disclose the flat contact surface with the carpet, does not provide for a contoured foreleg and foot support features and does not provide an inner cavity within the device containing additional weight to enhance the mass force of the knee hammer.

SUMMARY OF THE INVENTION

Carpet and flooring installation is a task which creates a great deal of stress on the lower body. An installer generally performs a majority of the installation task on his knees, as the installation occurs on the floor. During the installation of carpet, the floor surface is prepared, the carpet is measured and pre-cut to size, seams are matched, a pad and a perimeter tack strip is installed or an adhesive is spread to retain the carpet, and then the permanent installation is finally conducted. During this final installation, especially where a pad and tack strip is used, the carpet may be seamed, requiring two sections of carpet to be attached together by tape, heated glue, or heated tape, and then the outer edges of the carpet must be stretched to smooth the carpet surface and ensure the carpet is tight in all directions.

For seaming, vertical pressure must be applied to the seam for optimal seam adherence, the adhesive either being heat activated tape or an applied adhesive. Most commonly, a hot seaming iron is used to create the heat required to liquify the applied adhesive or adhesive on the tape, allowing the adhesives to melt into the lower surface of the carpet and adhere the two joined pieces of carpet at the seam when the adhesive cools and resolidifies.

For stretching and installation of the carpet to the tack strip, the carpet is stretch along the outer perimeter segment by segment using a carpet stretcher, commonly used in the industry. A carpet stretcher generally provides a kicking pad on a first end of an elongated shaft and a flat carpet contact end on the other end of the shaft, the contact end having lower surface defining a plurality of small sharp teeth that engage or "bite into" a portion of the outer edge of the carpet without damage to the carpet. The contact end engages the carpet edge, and the kicking pad is kicked by the installer to provide a temporary horizontal force to stretch that portion of the carpet as the lower surface of the carpet is attached to the tack strip or adhesive. The application of horizontal force is contemporaneous with the downward placement of the outer segment of the carpet. This is repeated numerous times during the installation until the entire outer perimeter of the carpet is tightly installed.

Thus, a device which minimized the impact to the knee and leg of the installer while maximizing the amount of horizontal force being applied to the carpet stretch would be greatly understood and appreciated by flooring installers and laborers. It is therefore an objective of the present knee hammer to provide the hammer with a forward contact surface to apply a horizontal force to a carpet stretcher which reduces the amount of impact force to the knee of the installer and distributes the impact forces to the entire lower leg. Another objective is to provide the device to be applied to the lower leg without straps, for quick and easy attachment to the lower leg of the installer when required. Another objective is to provide the device with an accessible cavity wherein additional weight may be added to increase the vertical mass forces of the knee hammer for seaming purposes and the horizontal mass forces of the knee hammer for use with the carpet stretcher or other knee actuated tool.

DESCRIPTION OF THE DRAWINGS

The following drawings are submitted with this utility patent application.

FIG. 6 is an exploded upper perspective view of the knee hammer, with broken lines representing the line of assembly and phantom lines representing at least one encapsulated weight upon the detachable lower closure plate.

DESCRIPTION OF THE PREFERRED EMBODIMENT

Figure 1:
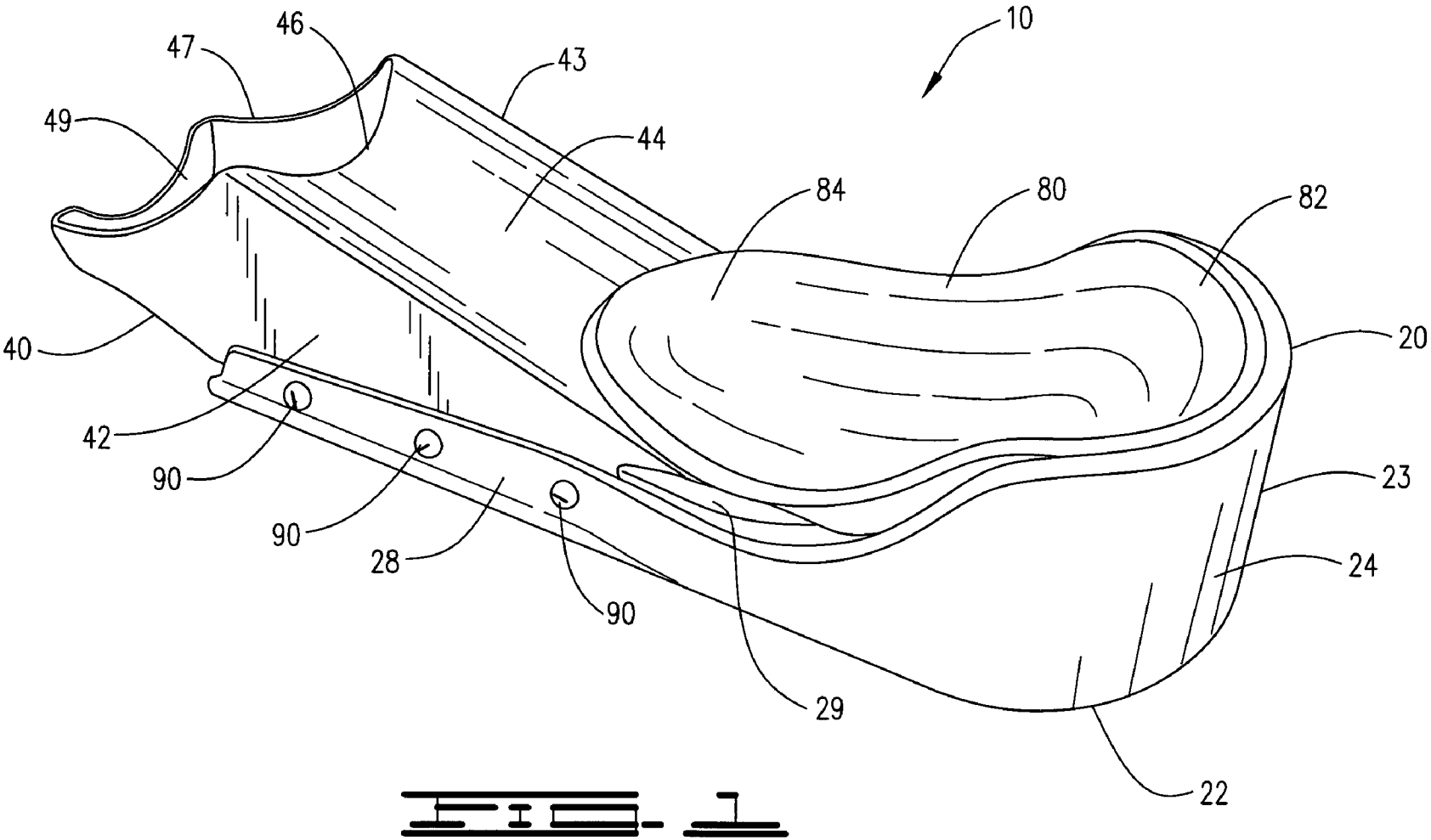
FIG. 1 is an upper front perspective view of the assembled knee hammer.
Figures 2, 3:
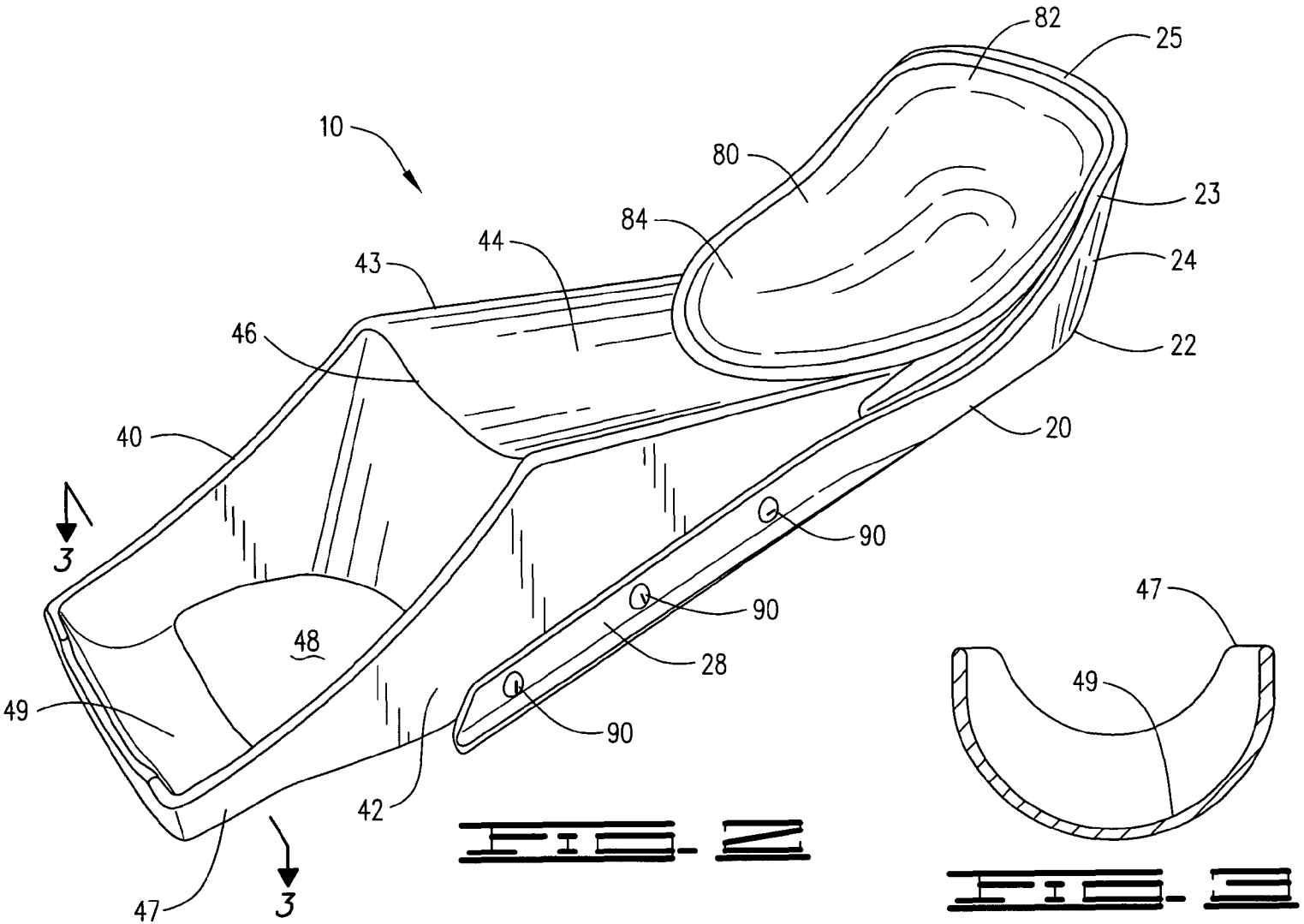
FIG. 2 is an upper rear perspective view of the assembled knee hammer.
FIG. 3 is a sectional view of the foot stirrup along section lines 3/3 of FIG. 2.

A knee hammer 10, worn by carpet installers for application to knee activated procedures, tasks and tools associated with carpet installation, shown in FIGS. 1-6 of the drawings, the knee hammer 10 comprising a knee segment 20 defining a smooth flat lower surface 21 having a beveled front edge 22, and an upper surface 23 having an outer front impact surface 24, a contoured inner forward knee section 25 defining an inner front impact surface 26 and a lower knee depression 27, two raised side margins 28 and a rear depression 29, a foreleg segment 40 including a lower surface opening 41, side sections 42, a detachable lower closure plate 60 having elevated side margins 62 attaching within the lower surface opening 41, an upper ramped portion 43 having a lateral concave surface 44, the lower surface opening 41, side sections 42, lower closure plate 60 and upper ramp portions 43 defining an inner cavity 45, a contoured ankle support 46 and a foot stirrup 47 defining a toe aperture 48 and a toe cup 49, the lower surface opening 41 of the foreleg segment 40 fitted within the rear depression 29 of the knee segment 20 at a distance between the inner forward knee section 25 and the foot stirrup 47 as desired by the installer, attaching the two raised side margins 28 of the knee segment 20 to the side sections 42 of the foreleg segment 40 by a plurality of pan head screws 90, and a densely padded knee cup 80 defining a front impact portion 82 and a lower vertical pressure portion 84, located within the inner forward knee section 25 subsequent to the attachment of the knee segment 20 and the foreleg segments 40, the knee cup 80 protecting a knee b from downward pressure as the knee b rests upon the lower vertical pressure portion 84 and the front impact portion 82 of the knee cup 80 protecting the knee b from forward impact forces generated by the installer when wearing and using the knee hammer 10 to horizontally kick drive a knee actuated carpet stretcher in a sliding horizontal manner without damage to his knee b while also to providing an applied downward force to a carpet seam when the flat lower surface 21 of the knee hammer 10 is slid over and upon a freshly joined carpet seam during installation.

Figure 4:
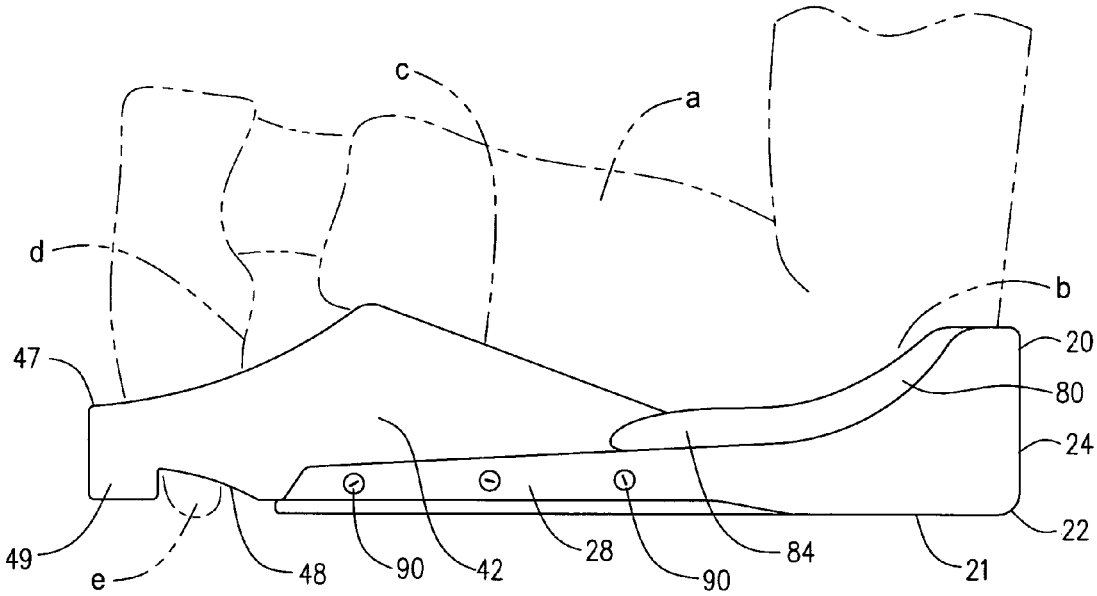
FIG. 4 is a side view of the assembled knee hammer, with phantom lines indicating the position of the installer's leg during use.
Figure 5:
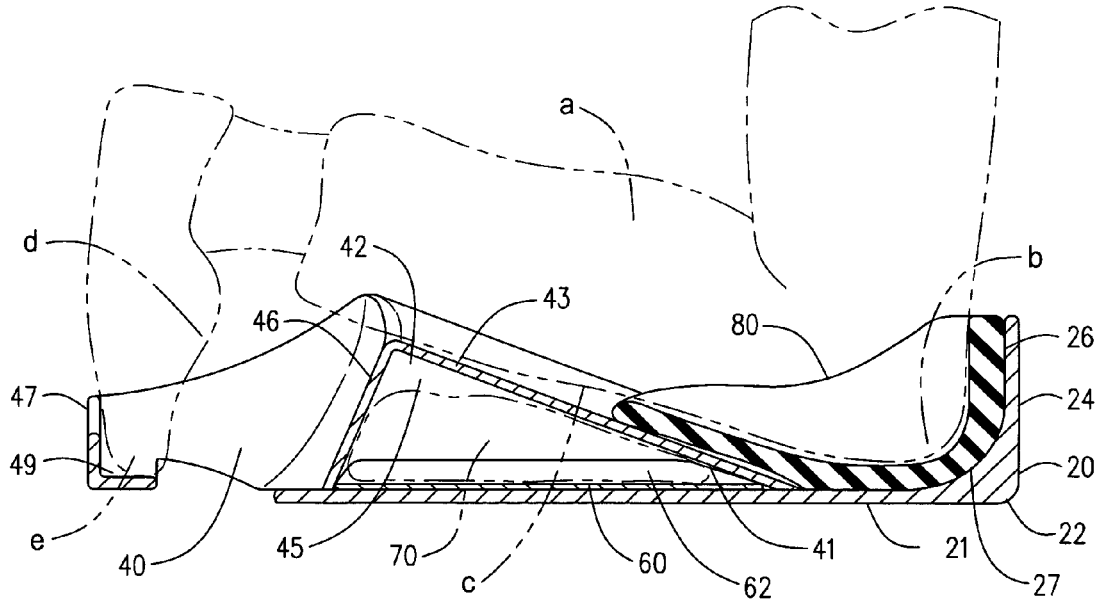
FIG. 5 is a cross-sectional side view of the assembled knee hammer with phantom lines representing at least one encapsulated weight within the inner cavity of the foreleg segment.
Figure 5:
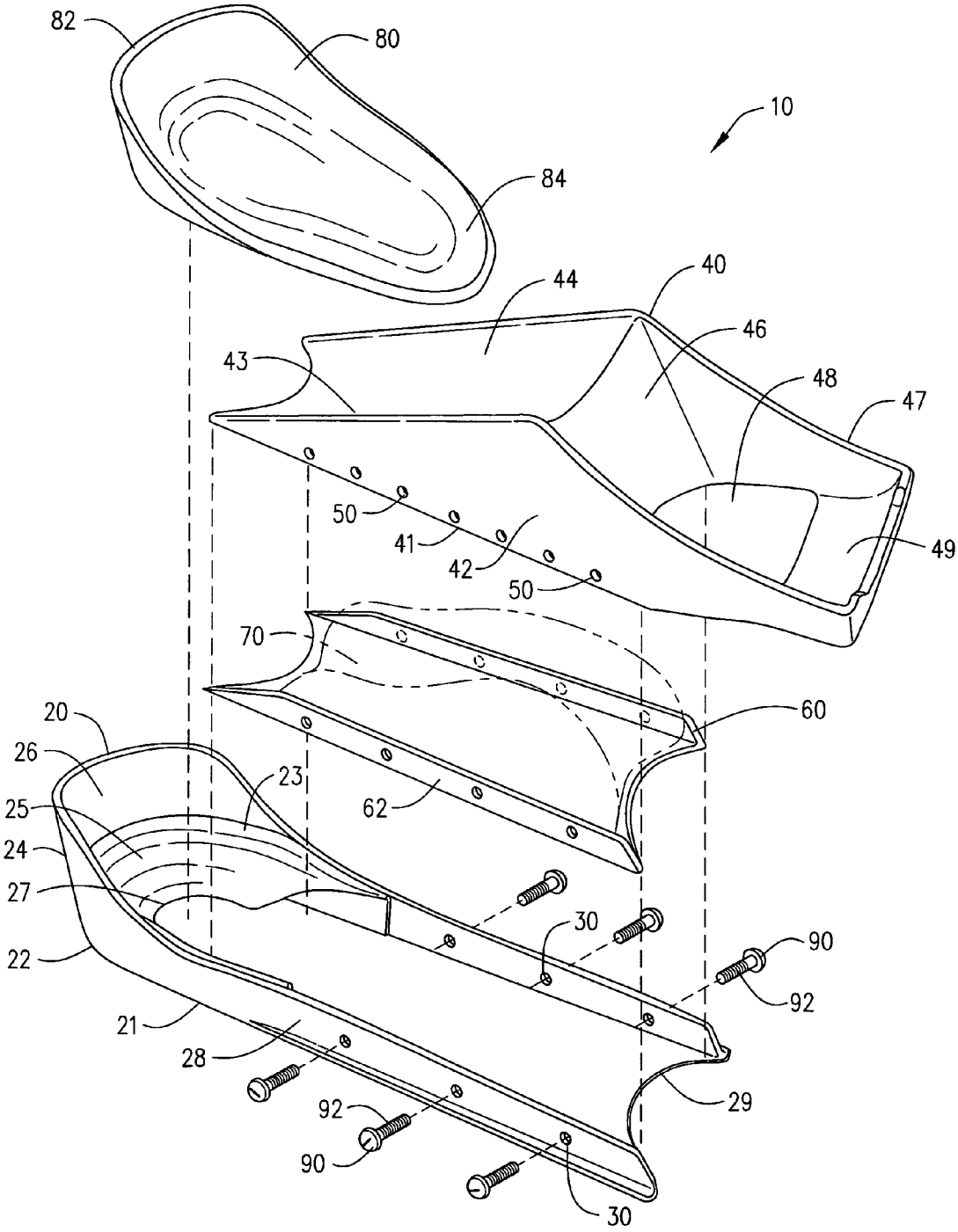

The knee hammer 10 is applied to the installer's lower leg a by placing the knee hammer 10 on the flooring surface, placing a knee b upon the knee cup 80, positioning a shin c on the upper ramped portion 43 and placing a top of a foot d over the ankle support 46 while a toe tip e is placed within the foot stirrup 47. FIGS. 4-5. When the installer desires to anchor the position of the knee hammer 10, the toe tip e of the installer is placed through the toe aperture 48, making contact through the toe aperture 48 with the floor, FIG. 4 indicating the installers toe tip e through the toe aperture 48. If the installer chooses to slide the device over the carpet being installed during application a horizontal striking force to a carpet stretcher when attaching the carpet edges to a tack strip or adhesive, the installer's toe tip e is placed within the toe cup 49, FIG. 5, and the knee hammer 10 is slid in a horizontal direction using a kicking motion to provide the horizontal impact, already used in the carpet installation industry without knee protection of any sort.

The knee hammer is also used when seaming carpet in the same manner, by placing the knee b upon the knee cup 80 and the toe tip e within the toe cup 49 as the smooth flat lower surface 21 of the knee hammer 10 slid over the freshly attached seam, the downward force of the installer upon the knee hammer 10 applying an even vertical force to enhance bonding and adhesion of the seam, whether carpet or other rolled and seamed flooring.

The knee hammer 10 may be provided with additional mass by placement of at least one encapsulated weight 70 within the cavity, FIGS. 5-6, increasing the driving mass of the knee hammer 10. The encapsulated weight 70 would best be provided by bags of sand or bags of weighted pellets. In this embodiment, the foreleg segment 40 would be detached from the knee segment 20 and the lower closure plate 60 detached, allowing access to the inner cavity 45 for the addition or subtraction of the encapsulated weight 70 from the knee hammer 10, as desired by the installer. In another embodiment, not shown, the lower closure plate may be permanently attached and a lower closure plate plug or cap would be fitted within the lower closure plate to allow the addition or subtraction of encapsulated weight from the knee hammer.

The knee cup 80 would be best provided as a dense foam rubber or gel foam product, with the front impact portion 82 being provided along the entire inner forward knee section 25, over the entire lower knee depression 27, with the lower vertical pressure portion 84 partially over the upper ramped portion 43, as shown in FIGS. 1-2 and 4-5, to protect the knee b of the installer as well as the soft tissues, tendons and ligaments in the knee from horizontal impact forces and vertical pressure forces encountered during use.

In the embodiment portrayed in FIG. 6, the raised side margins 28 of the knee segment 20 and the side sections 42 of the foreleg segment 40 would be provided with a respective plurality of threaded spaced holes 30, 50, the spaced holes 30, 50 of each respective segment contemporaneously aligning at least three matched pairs of spaced holes 30, 50 and placing one pan head screw 90 having an outer thread 92 in each set of aligned spaced holes 30, 50, to secure the knee segment 20 and foreleg segment 40 together in a chosen length and position. FIGS. 1, 2, 4 and 5. The pan head screws 90 may also extend a distance long enough to also engage the elevated side margins 62 of the lower closure plate 60 to the side sections 42 of the foreleg segment 40, completely enclosing the inner cavity 45 and securing the lower closure plate 60 within the lower surface opening 41, as indicated in FIGS. 5-6.

The knee hammer 10 should be made from molded impact resistant plastic, light metals including aluminum, or other metal or synthetic materials which would hold form, be durable enough to withstand thousands of impacts with knee actuated carpet installation tools, and sturdy enough to maintain its shape over repeated uses. It would also be adjustable in length to the extend that the average person of a normal height range can adjust the knee hammer 10 to a variety of lengths without modification of the manufactured knee hammer, by providing numerous spaced holes 30, 50 in either the knee segment 20, the foreleg segment 40 or both.

The knee hammer 10 may be worn as a single device to only one leg chosen by the installer and used for kicking, or two knee hammers 10 may be worn upon each leg as a means to provide smooth even pressure upon carpet which has been entirely glued to a surface, to assist in applying a smooth, even, and identical vertical force over a much more broad area of the glued carpet than a knee, being a preferred alternative to a weighted roller, often used in commercial carpet installation.

While the invention has been particularly shown and described with reference to a preferred embodiment thereof, it will be understood by those skilled in the art that changes in form and detail may be made therein without departing from the spirit and scope of the invention.

What is claimed is:

1. A knee hammer, worn by carpet installers for application to knee activated procedures, tasks and tools associated with carpet installation, said knee hammer comprising:

a knee segment defining a smooth flat lower surface having a beveled front edge, and an upper surface having an outer front impact surface, a contoured inner forward knee section defining an inner front impact surface and a lower knee depression, two raised side margins and a rear depression;

a foreleg segment including a lower surface opening, side sections, a detachable lower closure plate having elevated side margins attaching within said lower surface opening, an upper ramped portion having a lateral concave surface, said lower surface opening, side sections, lower closure plate and upper ramp portions defining an inner cavity, a contoured ankle support and a foot stirrup defining a toe aperture and a toe cup, said lower surface opening of said foreleg segment fitted within said rear depression of said knee segment at a distance between said inner forward knee section and said foot stirrup at a desired length by the installer, attaching said two raised side margins of said knee segment to said side sections of said foreleg segment by a plurality of pan head screws; and a densely padded knee cup defining a front impact portion and a lower vertical pressure portion, located within said inner forward knee section subsequent to attachment of said knee segment and said foreleg segments, said lower vertical pressure portion of said knee cup protecting the knee from downward pressure as the knee rests within said inner forward knee section and said front impact portion protecting said knee from forward impact forces generated by the installer when wearing and using said knee hammer to horizontally kick drive a separate external knee actuated carpet stretcher in a sliding horizontal manner without damage to his knee while also to providing downward pressure to a carpet seam when said flat lower surface of said knee hammer is applied upon a freshly joined carpet seam during installation.

2. The knee hammer as disclosed in claim 1, wherein said inner lower cavity may contain at least one encapsulated weight within said cavity, increasing a mass of said knee hammer, with the mass of said knee hammer adjusted by removing said foreleg segment from said knee segment, disengaging said lower closure plate from said lower surface opening and adding or removing said at least one encapsulated weight from said cavity of said knee hammer, as desired by the installer, and reassembling said knee hammer for use.

3. The knee hammer as disclosed in claim 1, said knee cup further comprising:

a dense foam product with said impact portion along said entire inner forward knee section, over said entire lower knee depression, and partially covering said upper ramped portion to fully protect the knee of the installer from horizontal impact forces and vertical pressure forces encountered during use.

4. The knee hammer as disclosed in claim 1, further comprising:

said raised side margins of said knee segment and said side sections of said foreleg segment respectively including a plurality of threaded spaced holes, said threaded spaced holes of each respective knee segment and foreleg segment contemporaneously aligning at least three matched pairs of aligned spaced holes, installing at least one of the plurality of pan head screws into each at least three matched pairs of aligned holes, each of said plurality of pan head screw having complementary outer thread mated to each said threaded spaced hole to secure said knee segment and foreleg segment together at a selected length and position.

5. The knee hammer as disclosed in claim 1, wherein said inner lower cavity may contain at least one encapsulated weight within said cavity, increasing a mass of said knee hammer, with the mass of said knee hammer adjusted by removing said foreleg segment from said knee segment, detaching said lower closure plate and adding or removing said at least one encapsulated weight from said cavity of said knee hammer, as desired by the installer, and reassembling said knee hammer for use; and said raised side margins of said knee segment and said side sections of said foreleg segment respectively including a plurality of threaded spaced holes, said threaded spaced holes of each respective knee segment and foreleg segment contemporaneously aligning at least three matched pairs of aligned spaced holes, installing at least one of the plurality of pan head screws into each at least three matched pairs of aligned holes, each of said plurality of pan head screw having complementary outer thread mated to each said threaded spaced hole to secure said knee segment and foreleg segment together at a selected length and position, said pan head screws further extended to additionally secure said extending side margins of said lower closure plate within said side sections of said foreleg segment, completely enclosing said inner cavity and securing said lower closure plate and said at least one encapsulated weight within said lower surface opening.

6. The knee hammer as disclosed in claim 1, wherein said knee hammer is anchored in a stationary position by the installer projecting a toe tip through said toe aperture making contact with a floor surface and mobilized in a horizontal position sliding said knee hammer over said floor surface providing a horizontal striking force, said installer's toe tip placed within said toe cup when applying a kicking motion to provide the horizontal striking force.

7. The knee hammer as disclosed in claim 1, further comprising:

said inner lower cavity may contain at least one encapsulated weight within said cavity, increasing a mass of said knee hammer, with the mass of said knee hammer adjusted by removing said foreleg segment from said knee segment, detaching said lower closure plate and adding or removing said at least one encapsulated weight from said cavity of said knee hammer, as desired by the installer, and reassembling said knee hammer for use;

said raised side margins of said knee segment and said side sections of said foreleg segment respectively including a plurality of threaded spaced holes, said threaded spaced holes of each respective knee segment and foreleg segment contemporaneously aligning at least three matched pairs of aligned spaced holes, installing at least one of the plurality of pan head screws into each at least three matched pairs of aligned holes, each of said plurality of pan head screw having complementary outer thread mated to each said threaded spaced hole to secure said knee segment and foreleg segment together at a selected length and position, said pan head screws further extended to additionally secure said extending side margins of said lower closure plate within said side sections of said foreleg segment, completely enclosing said inner cavity and securing said lower closure plate and said at least one encapsulated weight within said lower surface opening, and said knee cup further comprising a dense foam product with said impact portion along said entire inner forward knee section, over said entire lower knee depression, and partially covering said upper ramped portion to fully protect the knee of the installer from horizontal impact forces and vertical pressure forces encountered during use.

* * * * *